US010618322B2

(12) United States Patent
Yokota

(10) Patent No.: US 10,618,322 B2
(45) Date of Patent: Apr. 14, 2020

(54) PRINTING APPARATUS WITH LIGHT-SHIELDING PORTION

(71) Applicant: SEIKO EPSON CORPORATION, Tokyo (JP)

(72) Inventor: So Yokota, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/917,330

(22) Filed: Mar. 9, 2018

(65) Prior Publication Data

US 2018/0264858 A1 Sep. 20, 2018

(30) Foreign Application Priority Data

Mar. 17, 2017 (JP) ..... 2017-052596

(51) Int. Cl.

| | |
|---|---|
| ***B41J 11/20*** | (2006.01) |
| ***B41J 21/16*** | (2006.01) |
| ***B41J 3/60*** | (2006.01) |
| ***B41J 11/42*** | (2006.01) |
| ***B41J 11/46*** | (2006.01) |
| ***B41J 11/00*** | (2006.01) |

(52) U.S. Cl.

CPC ..... *B41J 11/20* (2013.01); *B41J 3/60* (2013.01); *B41J 11/0095* (2013.01); *B41J 11/42* (2013.01); *B41J 11/46* (2013.01); *B41J 21/16* (2013.01)

(58) Field of Classification Search

CPC ... B41J 21/16; B41J 11/20; B41J 11/42; B41J 3/60

See application file for complete search history.

(56) References Cited

U.S. PATENT DOCUMENTS

| | | | | |
|---|---|---|---|---|
| 5,701,547 | A * | 12/1997 | Yamada | B41J 11/0075 347/104 |
| 6,767,075 | B1 * | 7/2004 | Takada | B41J 2/1752 347/19 |
| 7,445,322 | B2 * | 11/2008 | Kitabatake | B41J 2/17553 347/86 |
| 7,621,616 | B2 * | 11/2009 | Mitani | B41J 2/16579 347/19 |
| 2005/0024415 | A1 * | 2/2005 | Claramunt | B41J 13/0009 347/19 |
| 2013/0141487 | A1 * | 6/2013 | Abe | B41J 11/00 347/16 |
| 2015/0273886 | A1 * | 10/2015 | Ide | B41J 11/0085 347/16 |

FOREIGN PATENT DOCUMENTS

| | | |
|---|---|---|
| JP | 2010-012757 | 1/2010 |

* cited by examiner

*Primary Examiner* — Henok D Legesse
(74) *Attorney, Agent, or Firm* — Workman Nydegger

(57) ABSTRACT

A printing apparatus includes a transport unit that transports a medium in a transport direction, a support portion that supports the medium that is transported by the transport unit in a width direction that intersects with the transport direction, a printing unit that performs printing on a front surface of the medium which is supported by the support portion, a detecting unit that receives reflected light which is emitted on a rear surface of the medium that is transported on a detection position that is provided in a transport path of the medium, and a light-shielding portion that faces the detecting unit with the medium interposed therebetween during at least transport of the medium by the transport unit.

8 Claims, 4 Drawing Sheets

PRINTING APPARATUS WITH LIGHT-SHIELDING PORTION

BACKGROUND

1. Technical Field

The present invention relates to a printing apparatus.

2. Related Art

In the related art, a printing apparatus is known that prints a first image on a rear surface and a second image on a front surface of a medium on which an alignment pattern is printed in alignment with the position of the first image on the rear surface side. In the printing apparatus, when the second image is printed on the front surface of the medium, the alignment pattern is detected by an optical sensor that is disposed at a position that faces the rear surface of the medium, and a printing position of the second image is adjusted based on the detection result (for example, JP-A-2010-12757).

Note that, it is often the case that in the optical sensor, a light receiving section that receives reflected light faces upward in order to detect the alignment pattern that is printed on the rear surface of the medium based on intensity of reflected light which is irradiated from the position that faces the rear surface of the medium. Therefore, there is a concern that such an optical sensor tends to receive influence of ambient light other than reflected light which is irradiated from the sensor and the pattern is erroneously detected.

SUMMARY

An advantage of some aspects of the invention is to provide a printing apparatus that detects an alignment pattern that is printed on a rear surface of a medium at a position that faces a rear surface of the medium, and is able to suppress erroneous detection of the pattern according to influence of ambient light in a case where an image is printed on the front surface of the medium based on the detection result.

Hereinafter, means of the invention and operation effects thereof will be described.

According to an aspect of the invention, there is provided a printing apparatus provided with a transport unit that transports a medium in a transport direction, a support portion that supports the medium which is transported by the transport unit in a width direction that intersects with the transport direction, a printing unit that performs printing on a front surface of the medium which is supported by the support portion, a detecting unit that receives reflected light which is emitted on a rear surface of the medium that is transported on a detection position that is provided in a transport path of the medium, and a light-shielding portion that faces the detecting unit with the medium interposed therebetween during at least transport of the medium by the transport unit.

According to the configuration described above, the detecting unit tends not to receive influence of the reflected light since there is a high possibility that light from a side that faces the detecting unit toward the detecting unit is blocked by the light-shielding portion interposing the medium. Therefore, the alignment pattern that is printed on a rear surface of the medium is detected at a position that faces a rear surface of the medium, and it is possible to suppress erroneous detection of the pattern according to influence of ambient light in a case where an image is printed on the front surface of the medium based on the detection result.

In the printing apparatus, preferably in a state of interposing the medium and facing the detecting unit, the light-shielding portion has a reflecting portion that is able to reflect light, that is irradiated from the detecting unit, toward the detecting unit.

According to the configuration described above, in a case where, for example, the medium is transparent or semi-transparent, it is possible to reflect light, that is irradiated from the detecting unit, to a side at which the light-shielding portion is positioned and passes through the medium using the reflecting portion that the light-shielding portion has, and receive reflected light in the detecting unit by passing through the medium from the side at which the light-shielding portion is positioned to the side at which the detecting unit is positioned.

In the printing apparatus, preferably the detection position is positioned further on an upstream side of the printing unit in the transport direction.

According to the configuration described above, it is possible to detect an alignment pattern of a subsequent image from the rear surface of the medium during printing the previous image in a case where a plurality of images are printed in a gap in the transport direction of the medium with respect to the front surface of the transported medium. Therefore, it is possible to seamlessly connect printing of a previous image and printing of a later image, and it is possible to improve throughput.

In the printing apparatus, preferably the transport unit is positioned further on an upstream side of the support portion in the transport direction, and the detecting unit detects an alignment pattern from a rear surface of the medium that is transported to a downstream side in the transport direction by the transport unit, and is in a state of being supported by the support portion.

According to the configuration described above, it is possible to support a medium in a stable posture state using a support portion and it is possible to secure detection precision of a pattern when an alignment pattern that is printed on the rear surface of the medium is detected by the detecting unit at a position facing the rear surface of the medium.

In the printing apparatus, preferably the light-shielding portion is provided in the printing unit that is configured to be movable in the width direction of the medium.

According to the configuration described above, it is possible to improve detection precision of the detecting unit that receives reflected light which is emitted on the rear surface of the transported medium in a so-called serial-type printing apparatus that prints an image on the front surface of the medium while the printing apparatus moves the printing unit in the width direction of the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
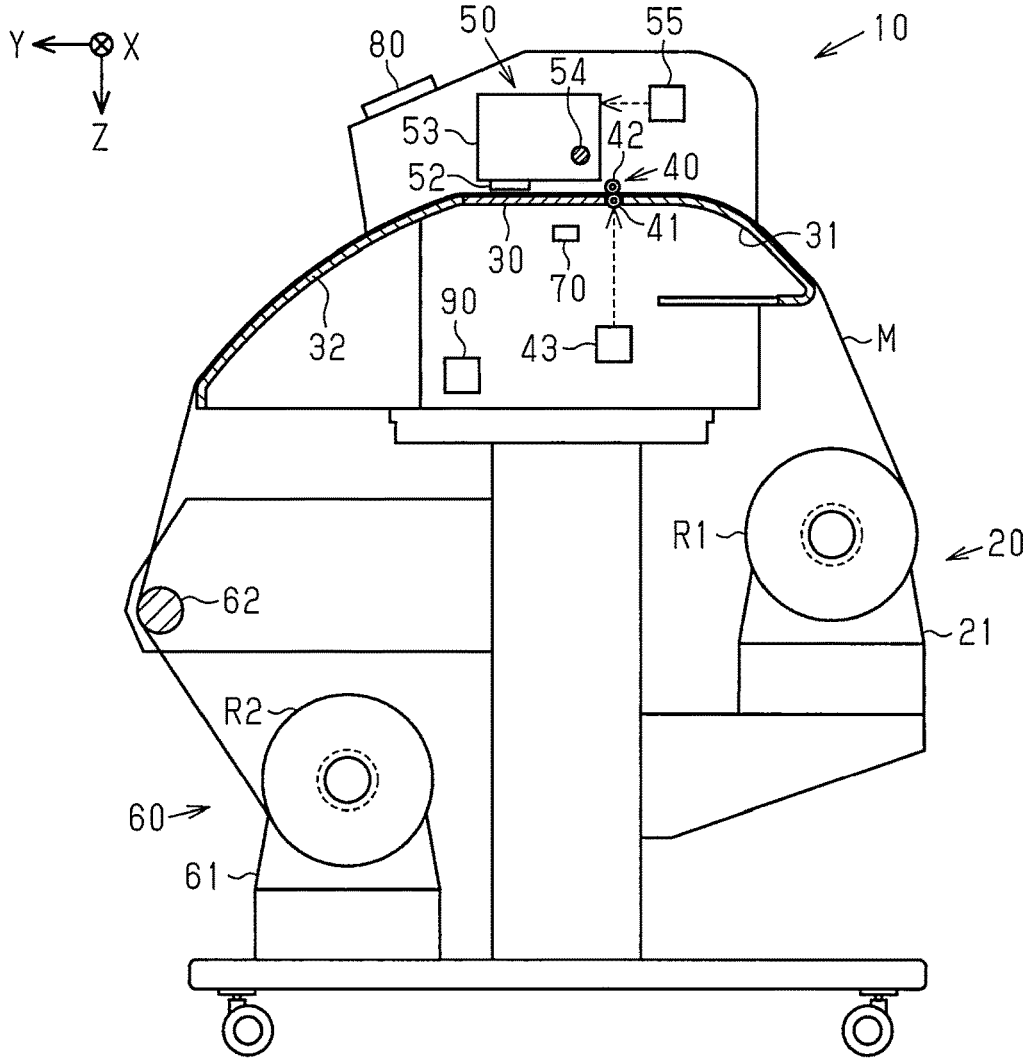
FIG. 1 is a side view illustrating an outline configuration of an embodiment of a printing apparatus.

An embodiment of a printing apparatus will be described below with reference to the drawings. Note that, the printing apparatus of the present embodiment is an ink jet printer which prints an image by discharging ink on a medium such as a paper sheet which is unwound from a paper roll. Characters, symbols, or the like are included in an image referred to in the embodiment. In addition, in the drawings, the printing apparatus that has a predetermined height in an up and down direction, a predetermined width in a left and right direction, and a predetermined depth in a front and rear direction is placed on a horizontal plane. Then, in each diagram, a height direction of a printing apparatus 10 indicates an "up and down direction Z" using an arrow, a width direction of the printing apparatus 10 along the horizontal plane that is orthogonal to the up and down direction Z indicates s "width direction X" using an arrow, and a depth direction of the printing apparatus 10 along the horizontal plane orthogonal to the up and down direction Z and the width direction X indicates a "front and rear direction Y" using an arrow.

As shown in FIG. 1, a printing apparatus 10 is provided with a feeding portion 20 which unwinds and feeds out a medium M from a roll body R1 that is wound up in a roll shape along a transport direction, a support portion 30 that supports the medium M, a transport unit 40 which transports the medium M, a printing unit 50 which performs printing on the medium M, and a winding portion 60 which winds the medium M. In addition, the printing apparatus 10 is provided with a detecting unit 70 that detects reflected light from the medium M that is transported in a transport path along an upper surface of the support portion 30, an operation portion 80 that is operated by a user (operator), and a control portion 90 that controls driving of a configuring member of the printing apparatus 10.

The feeding portion 20 has a holding portion 21 which holds a roll body R1 on which the medium M is wound in a roll shape to be freely attachable and detachable. The feeding portion 20 feeds out the medium M that is unwound from the roll body R1 by rotating the roll body R1 in one direction (counterclockwise direction in FIG. 1). Note that, in the printing apparatus 10 of the embodiment, the medium M that has transmittance such as a transparent or semi-transparent film and thin paper and not a non-transparent medium such as normal paper is used as the medium M on which an image is printed.

Figure 2:
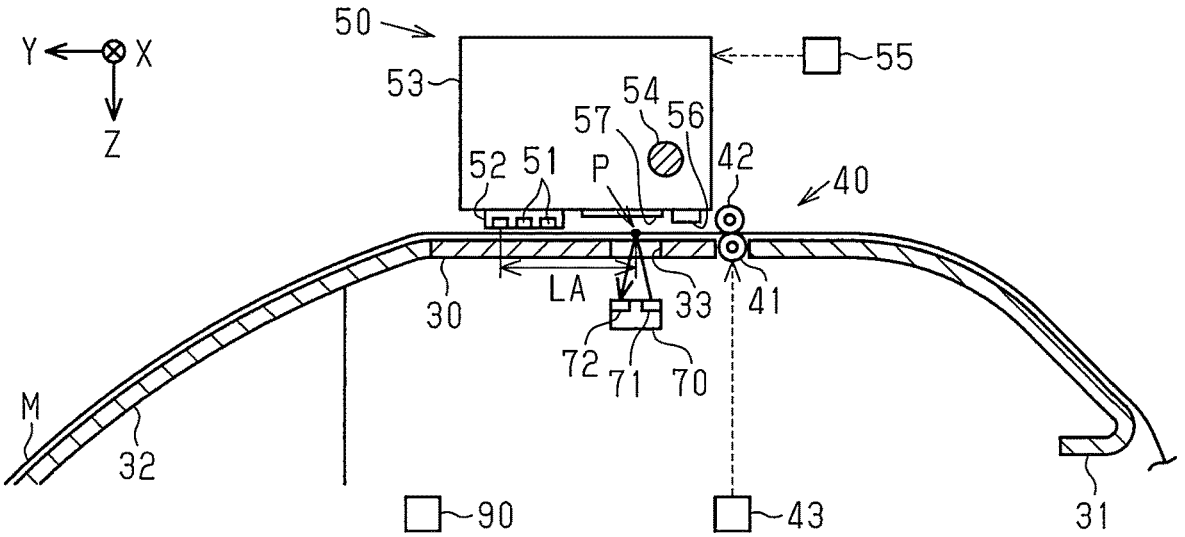
FIG. 2 is a side view illustrating an outline configuration of a main portion of the printing apparatus.
Figure 3:
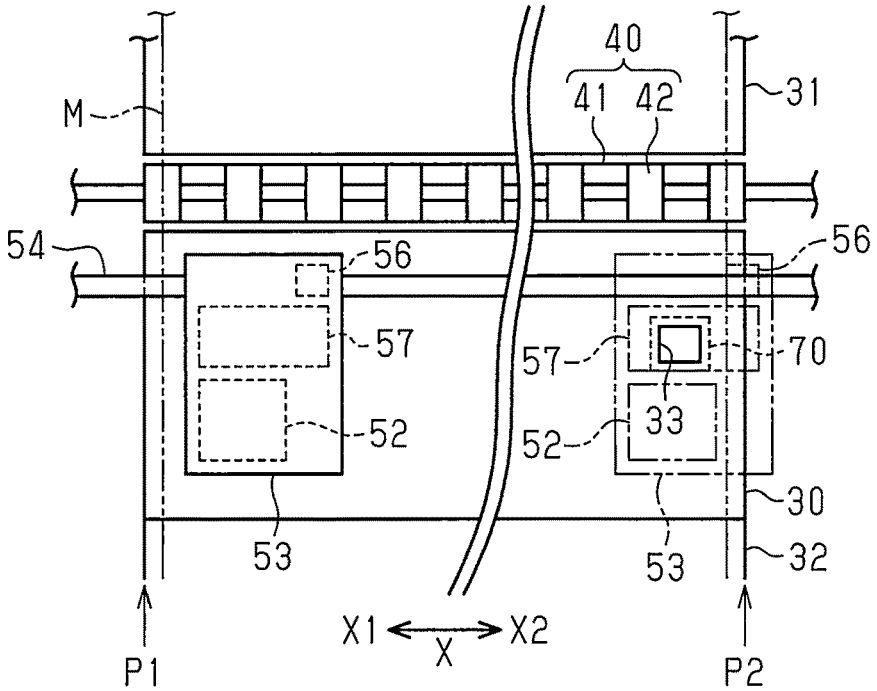
FIG. 3 is a planar view illustrating an outline configuration of the main portion of the printing apparatus.

As shown in FIGS. 2 and 3, the support portion 30 has a plate shape in which the width direction X is a longitudinal direction and the transport direction of the medium M is a transverse direction. An upstream side guiding portion 31 that guides the medium M that is fed out from the feeding portion 20 on the support portion 30 is provided on the transport direction upstream side of the medium M in the support portion 30. In addition, a downstream side guiding portion 32 that guides the medium M that is fed out from the support portion 30 toward the winding portion 60 is provided on the transport direction downstream side of the medium M in the support portion 30. Then, an opening 33 that exposes the rear surface of the medium M that passes on the support portion 30 in the transport direction on the rear side (lower side in FIGS. 1 and 2) of the support portion 30 is formed through the support portion 30. Preferably, the opening 33 is formed in a transport region that passes on the support portion 30 when the medium M is transported from the upstream side to the downstream side.

Note that, preferably in the printing apparatus 10, in the case of a device configuration in which the medium M is transported to the width direction center of the support portion 30, the opening 33 is formed in the center of the width direction X of the support portion 30. In addition, preferably in the printing apparatus 10, in the case of a device configuration in which the medium M is transported to one side in the width direction of the support portion 30, the opening 33 is formed on the one side of the width direction X of the support portion 30. In the embodiment, the opening 33 is formed at a position at a near one side at a second end X2 when one end (left end in FIG. 3) in the width direction X in the support portion 30 is a first end X1 and another end (right end in FIG. 3) in the width direction X is the second end X2.

The transport unit 40 is provided with a driving roller 41 that is positioned further on the upstream side in the transport direction of the medium M than the support portion 30 and is disposed below the transport path of the medium M, and a driven roller 42 that is disposed above the transport path of the medium M. In addition, the transport unit 40 is provided with a transport motor 43 that drives the driving roller 41. The driving roller 41 and the driven roller 42 are rollers for rotating for which the width direction X is set as a revolving shaft direction. The transport unit 40 transports the medium M that is fed out from the feeding portion 20 in the transport direction by driving the transport motor 43 in a state in which the medium M is interposed between the driving roller 41 and the driven roller 42.

As shown in FIGS. 1 and 2, the printing unit 50 is provided with a discharge portion 52 in which a nozzle 51 that discharges ink is formed, and a carriage 53 that supports and moves the discharge portion 52. In addition, the printing unit 50 is provided with a guide shaft 54 that supports the carriage 53 to be reciprocally movable in the width direction X, and a movement mechanism 55 that reciprocally moves the carriage 53 in the axial direction (the width direction X) of the guide shaft 54.

The discharge portion 52 is supported on the lower surface of the carriage 53. The discharge portion 52 has a plurality of nozzles 51 that discharge different types of ink (for example, cyan ink, magenta ink, yellow ink, and black ink) toward the support portion 30. In addition, in the discharge portion 52, a nozzle row is configured by aligning the plurality of nozzles 51 that discharge ink of the same type in a direction (for example, the transport direction of the medium M) that intersects with the width direction X.

In the printing unit 50, the movement mechanism 55 moves the carriage 53 in the width direction X based on a printing command and the like from a user. In addition, when the carriage 53 is moved in the width direction X, the discharge portion 52 discharges ink on the medium M which is supported on the support portion 30. In this manner, the printing unit 50 prints an image on the front surface of the medium M. Concerning this point, the printing apparatus 10 of the embodiment is a so-called serial-type printing apparatus that prints an image on the front surface of the medium M while the printing unit 50 moves in the width direction X of the medium M.

As shown in FIGS. 2 and 3, an optical detection unit 56 is provided at a position not overlapping with the discharge portion 52 in the width direction X and the front and rear direction Y on the lower surface of the carriage 53. The detection unit 56 is a reflective-type optical sensor that has a light projecting portion that irradiates light and a light receiving portion that receives light. The detection unit 56 performs "detection" by irradiating (projecting) light toward the support portion 30 and receiving the reflected light. Note that, the direction in which light of the detection unit 56 is irradiated may also be referred to as a direction in which the discharge portion 52 discharges ink. The detection unit 56 is positioned further to the rear side (upstream side in the transport direction) than the opening 33 that is formed on the support portion 30 in the front and rear direction Y which is also the transport direction of the medium M.

In addition, a reflecting portion 57 that reflects light on a position between the discharge portion 52 and the detection unit 56 in the front and rear direction Y is provided on the lower surface of the carriage 53. For example, the reflecting portion 57 is configured by a rectangular shape plate in which the front surface has a white or mirror finish. The reflecting portion 57 is provided at a position that faces the up and down direction Z and interposes the medium M with the opening 33 that is formed in the support portion 30 in a case where the carriage 53 is positioned at a second position P2 that is an end portion position on the second end X2 side in the width direction X in the support portion 30. Then, in this positional state, the reflecting portion 57 reflects light that is irradiated through the opening 33 from the lower side of the support portion 30, and irradiates again the reflected light on the lower side of the support portion 30 through the opening 33.

The winding portion 60 is provided with a holding portion 61 that holds a roll body R2 on which the medium M is wound to be freely attachable and detachable, and a tension bar 62 that imparts tension (tensile force) on the medium M in the direction that intersects with the transport direction. The winding portion 60 winds the medium M that is wound on the tension bar 62 by rotating the roll body R2 in one direction (counterclockwise direction in FIG. 1).

As shown in FIGS. 2 and 3, the detecting unit 70 is provided at a position that does not overlap with the opening 33 in the up and down direction Z on the lower side of the support portion 30. Then, the detecting unit 70 is provided with a light projecting portion 71 that irradiates light toward the transport path of the medium M through the opening 33, and a light receiving portion 72 that receives light that is incident through the opening 33 from the transport path of the medium M, and outputs a signal according to intensity of reflected light that is received by the light receiving portion 72. That is, the detecting unit 70 may be a reflective-type optical sensor, and the light that is handled by the detecting unit 70 may be visible light and may be infrared light.

Hereinafter in the description, a position at which the detecting unit 70 detects the medium M through the opening 33 is referred to as a "detection position P". The detection position P is provided in the transport path of the medium M further on the upstream side in the transport direction than the printing unit 50 and further on the downstream side in the transport direction than the transport unit 40. That is, in the embodiment, the position at which the opening 33 is formed in the support portion 30 is the detection position P. In addition, in the transport direction, the distance between the detection position P and the nozzle 51 furthest on the downstream side of the discharge portion 52 is set as a "reference distance LA". The reference distance LA is a distance that is determined accompanying the design of the printing apparatus 10.

Next, the control portion 90 will be described.

The detection unit 56, the detecting unit 70, and the operation portion 80 are connected in an input side interface of the control portion 90. Meanwhile, the feeding portion 20, the transport unit 40, the printing unit 50 (discharge portion 52 and movement mechanism 55), and the winding portion 60 are connected to an output side interface of the control portion 90.

The control portion 90 executes a printing process based on a print job that is transmitted from a computer and the like that is connected to the printing apparatus 10. In detail, the control portion 90 controls the feeding portion 20, the transport unit 40, and the winding portion 60, and executes a transport process in which the medium M is transported in the transport direction. In addition, the control portion 90 controls the discharge portion 52 and the movement mechanism 55, and executes a discharge process in which ink is discharged from the discharge portion 52 toward the medium M while moving the carriage 53 in the width direction X. Then, the control portion 90 alternately executes the transport process and the discharge process, and executes a printing process in which an image is printed on a medium M. Note that, the print job is data that includes information about the image that is to be printed on the medium M and information that relates to a printing method.

In this arrangement, the printing apparatus 10 of the embodiment is able to perform "single-side printing" in which printing is performed on one surface of the medium M on which printing is not performed on both surfaces (front surface and rear surface), and perform "double-side printing" in which printing is performed on the other surface of the medium M on which printing is performed on the one surface. That is, the control portion 90 executes the printing process for "single-side printing" in which an image is printed on the front surface of the medium M on which the image is not printed on the rear surface and the printing process for "double-side printing" in which an image is printed on the front surface of the medium M on which the image is printed on the rear surface. However, the printing apparatus 10 of the embodiment is not provided with an inverting mechanism that inverts the front and rear of the medium M, therefore the printing apparatus 10 performs double-side printing by removing the roll body R2, on which the medium M is wound, from the winding portion 60 and resetting the roll body R2 on the holding portion 21 of the feeding portion 20 after winding the medium M on which printing is performed on one surface (single-side printing) using the winding portion 60.

Figure 4:
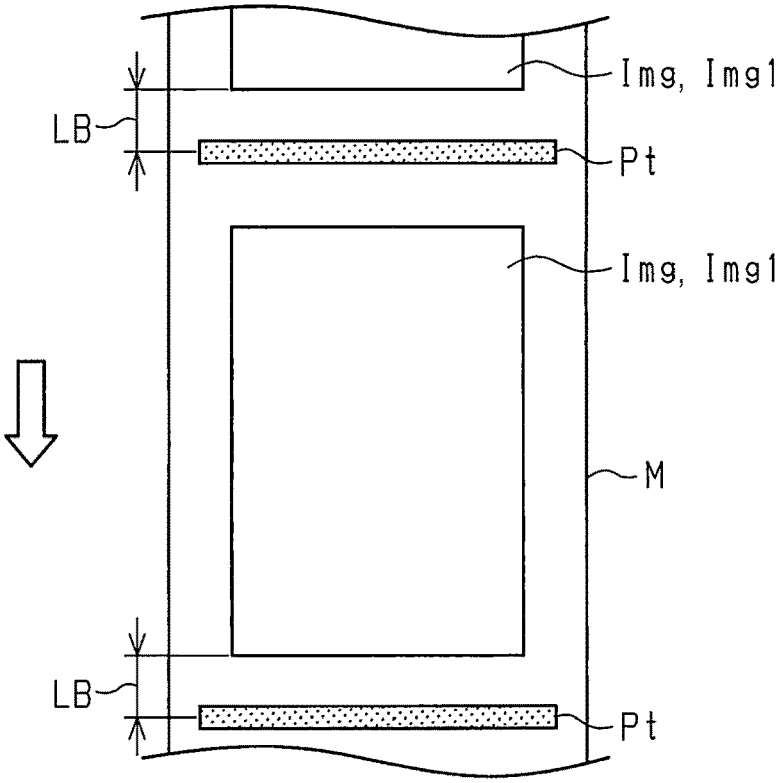
FIG. 4 is a planar view illustrating the medium that is printed on a single side.
Figure 5:
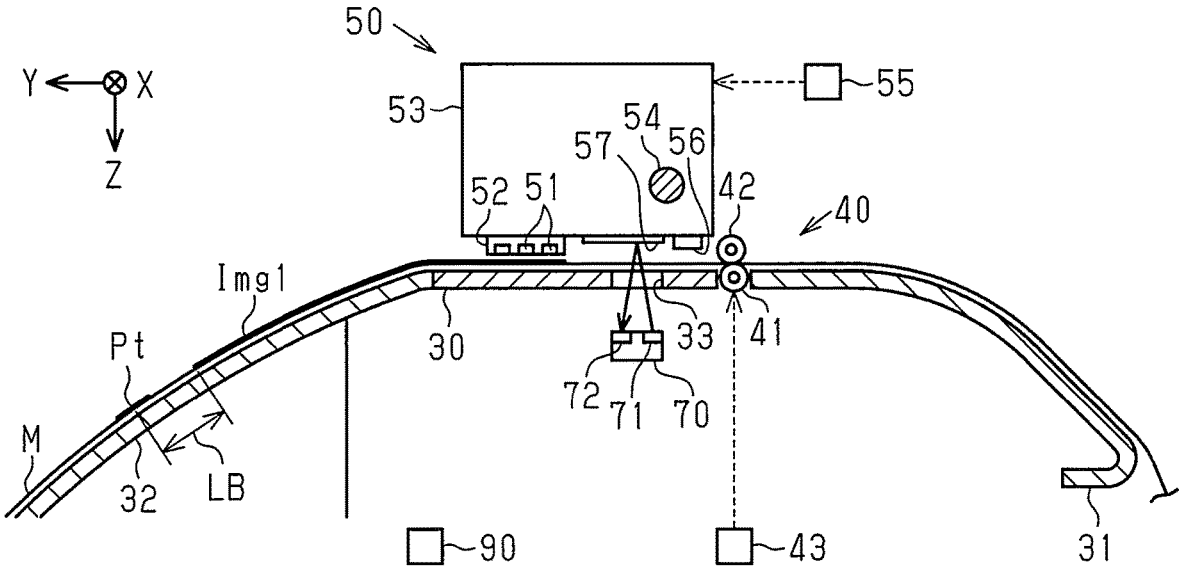
FIG. 5 is a side view illustrating an outline configuration of the main portion of the printing apparatus during single-side printing.

As shown in FIGS. 4 and 5, the control portion 90 prints a pattern Pt before an image Img (Img 1) during single-side printing on one surface that is a previous stage of double-side printing. In other words, the control portion 90 prints the pattern Pt further on the downstream side in the transport direction that is indicated by an outline arrow than the printing position of the image Img (Img 1) on the medium M during single-side printing. The pattern Pt is a pattern for alignment that indicates that the image Img (Img 1) is printed from a position that is moved from the printing position of the pattern Pt to the upstream side of the transport direction by a printing gap LB. Note that, the pattern Pt may be a shape that is readable by the detecting unit 70. In the embodiment, for ease of understanding of the description, the width direction X extends as a longitudinal direction, and the pattern Pt is constituted by straight lines of different colors from the medium M.

Figure 6:
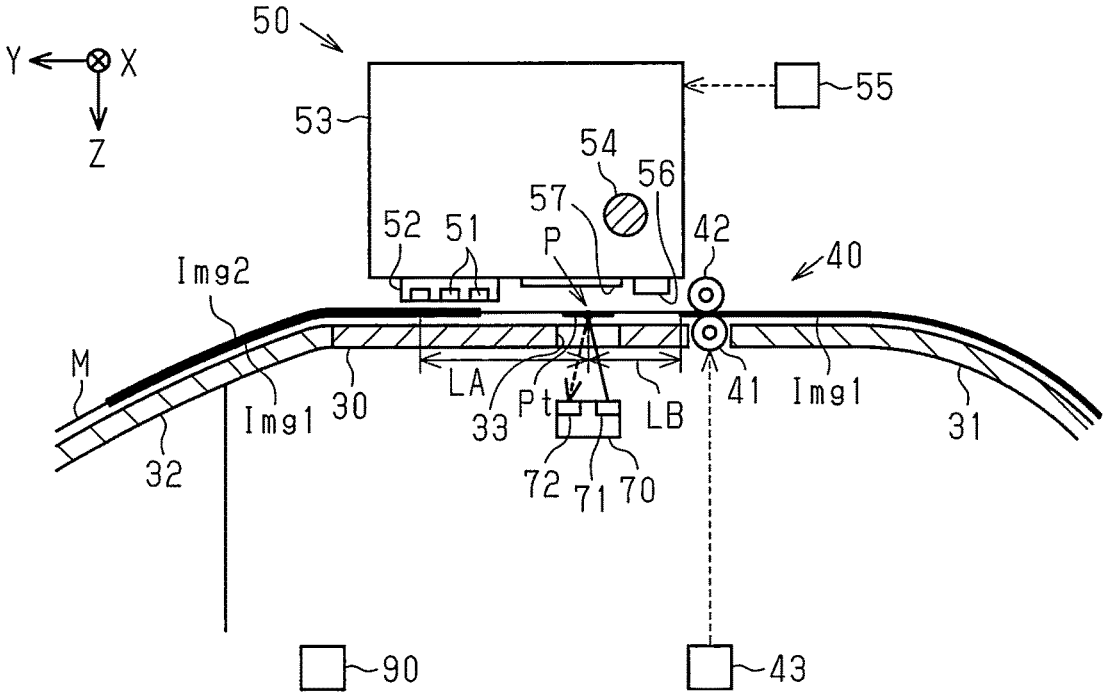
FIG. 6 is a side view illustrating an outline configuration of the main portion of the printing apparatus during double-side printing.

In addition, as shown in FIG. 6, the control portion 90 may print an image Img 2 that corresponds to image Img 1 that is printed on the rear surface of the medium M on the front surface of the medium M in the case of double-side printing. For example, the image Img 2 that is printed on the front surface of the medium M has the same pattern and size as the image Img 1 that is printed on the rear surface of the medium M. In such a case, the control portion 90 prints the image Img 2 in a printing range of the image Img 1 that is printed on the rear surface of the medium M and a printing range that corresponds to the front and rear on the front surface of the medium M based on a detection result of the pattern Pt by the detecting unit 70.

In detail, the control portion 90 acquires the printing position of the image Img 1 on the rear surface side based on the detection of the pattern Pt that is printed on the rear surface of the medium M by the detecting unit 70 during double-side printing. Subsequently, the control portion 90 sets a position at which a distance that is equivalent to the sum of the reference distance LA and the printing gap LB from the detection position P of the pattern Pt is transported to a printing start position of the image Img 2 on the front surface side. As a result, the image Img 2 on the front surface side is printed in the printing range in which the image Img 1 on the rear surface side is printed and the printing range that corresponds to the front and rear.

In addition, the control portion 90 moves the carriage 53 in the width direction X before printing starts, and determines whether or not the medium M is present on the support portion 30 or determines whether the end portion of the medium M is positioned at any position on the support portion 30 based on a signal that is transmitted from the detection unit 56. That is, the control portion 90 performs detection of the medium M in the detection unit 56 while moving the carriage 53 from the first position P1 that is the end portion position on the first end X1 side to the second position P2 that is the end portion position on the second end X2 side in the width direction X in the support portion 30. In detail, the control portion 90 receives from the detection unit 56 a signal according to intensity of the reflected light that is received by the detection unit 56 (hereinafter, refer to "received light intensity"). In this manner, the control portion 90 acquires a transition of the received light intensity according to the position of the detection unit 56 in the width direction X.

In this arrangement, in the embodiment, reflectance of the front surface of the support portion 30 that supports the medium M is set to be lower than the reflectance of the front surface of the medium M. Therefore, the control portion 90 is able to determine that the end portion of the medium M that is present at a position at which the received light intensity greatly changes. For example, an intermediate value of a received light intensity of the reflected light when light is emitted on the front surface of the support portion 30 by the detection unit 56 and the received light intensity of the reflected light when light is emitted on the front surface of the medium M is a threshold. In this case, the control portion 90 is able to determine that an end portion of the medium M is present at a position at which received light intensity comes to be in a state of a threshold or more from a state of being less than the threshold and received light intensity comes to be in a state of being less than the threshold from a state of being the threshold or more. Then, the position of the end portion of the medium M that is detected in such a manner is used to determine whether or not the medium M is correctly set on the support portion 30 or in the printing process thereafter, used to determine the region into which ink is dischargeable.

Next, actions of the printing apparatus 10 of the embodiment will be described below focusing on the printing process that is performed by the control portion 90.

First, as shown in FIG. 5, the pattern Pt and the image Img (Img 1) are printed on one surface that is on the opposite side from the side that corresponds to the upper surface of the support portion 30 on the medium M that is transported in the transport path during single-side printing. At this time, the image Img (Img 1) starts printing from a position that is moved to the transport direction upstream side by the printing gap LB from the position at which the pattern Pt is printed on the one surface on the medium M. Then, when printing (single-side printing) of the pattern Pt and the image Img (Img 1) that correspond to the one surface on the medium M ends, the roll body R2 on which the medium M is wound is removed from the winding portion 60, and printing restarts on the holding portion 21 of the feeding portion 20 for subsequent double-side printing.

Note that, before starting printing on the medium M during single-side printing, the position of the end portion of the medium M is detected by the detection unit 56 that is attached to the lower surface of the carriage 53. That is, the carriage 53 is moved from the first position P1 to the second position P2 in the width direction X on the support portion 30, and light is irradiated from the detection unit 56 toward the support portion 30 during movement. By doing this, the light is reflected on the front surface of the support portion 30 or the front surface of the medium M, and the reflected light is reflected by the detection unit 56. Then, the position of the end portion of the medium M is determined by the control portion 90 based on the change of the received light intensity in that case, and the pattern Pt and the image Img (Img 1) is printed in the printing range on the medium M that is set by the control portion 90 based on the determination result.

In addition, as shown in FIG. 5, when the medium M is transported on the support portion 30, light is irradiated from the light projecting portion 71 of the detecting unit 70 that is positioned on the lower side of the support portion 30 via the opening 33 with respect to the rear surface of the medium M. In this case, the medium M in the embodiment is a medium M having transmittance such as thin paper, therefore most of the light that is irradiated from the light projecting portion 71 passes through the medium M, and the reflected light, which is reflected on the rear surface of the medium M, becomes slight toward the detecting unit 70. Therefore, even if such slight reflected light is received by the light receiving portion 72 of the detecting unit 70, the received light intensity in such a case has almost no difference from the case where the reflected light of the irradiated light is not received.

However, as described above, the position of the end portion of the medium M is to be detected before the start of printing, when the carriage 53 is moved to the second position P2 on the support portion 30, as shown in FIG. 3, the reflecting portion 57 on the lower surface of the carriage 53 is positioned at the upper position of the opening 33. Therefore, as shown in FIG. 5, the light that is irradiated so as to pass through the opening 33 from the light projecting portion 71 of the detecting unit 70 and that passes through the medium M from the rear surface side to the front surface side is reflected on the reflecting portion 57 and the next time passes through the medium M from the front surface side to the rear surface side. Then, light that is irradiated from the light projecting portion 71 and reflected light with an approximately equal light intensity passes through the opening 33 again and is received in the light receiving portion 72 of the detecting unit 70. That is, unlike in a case where reflected light is slight, in the same manner in a case where the medium M is white plain paper or the like that does not have transmittance, sufficient reflected light that is received light intensity of a threshold or more that is set in advance for use in presence or absence determination of the pattern Pt is received by the light receiving portion 72 of the detecting unit 70.

Next, as shown in FIG. 6, during double-side printing, the pattern Pt that is printed on the rear surface of the medium M which is transported in the transport direction is detected by the detecting unit 70 via the opening 33 of the support portion 30. During double-side printing in the embodiment, a plurality of images Img (Img 2) are printed with gaps in the transport direction on the front surface of the medium M. Then, the detection process of the pattern Pt by the detecting unit 70 in such a case is performed during printing of the previous image Img 2 on the front surface further on the front side in the transport direction of the medium M than the pattern Pt. Specifically, the detecting unit 70 detects the pattern Pt that is printed on the rear surface of the medium M directly before printing of the previous image Img 2 by the discharge portion 52 on the front surface of the medium M that is transported on the support portion 30 is complete. Note that, during double-side printing, the printing positions of the pattern Pt and the image Img in the transport direction of the medium M is set such that the detection position P on the opening 33 is passed through by the pattern Pt on the rear surface of the medium M at such a timing.

In the detection process of such a pattern Pt, light that is emitted on the rear surface of the medium M via the opening 33 from the light projecting portion 71 of the detecting unit 70 is absorbed in the pattern Pt that is printed, for example, with a black color or the like with low reflectance in a case where the pattern Pt is positioned at the detection position P that corresponds to the opening 33. That is, since the light that is emitted on the pattern Pt is absorbed, there is almost no reflected light. Therefore, the received light intensity of the light receiving portion 72 in the detecting unit 70 in this case is weak received light intensity less than the threshold that is set in advance for use in presence or absence determination of the pattern Pt. As a result, the control portion 90 determines that the pattern Pt that is printed on the rear surface of the medium M is present at the detection position P, and controls the transport unit 40 to transport the medium M to the downstream side in the transport direction by a distance that is equivalent to the sum of the reference distance LA and the printing gap LB. After that, the image Img (Img 2) is printed on the front surface of the medium M by the printing unit 50 that is controlled in the control portion 90.

Note that, in the detection process of the pattern Pt that is printed on the rear surface of the medium M, in a case where the medium M has transmittance such as of thin paper, ambient light passes through the medium M and is easily incident on the detecting unit 70 from a side facing the detecting unit 70, that is, the upper side, interposing the medium M in the up and down direction Z. Therefore, there is a possibility that detection precision of the pattern Pt by the detecting unit 70 is lowered. However, in this case, the carriage 53 that has the reflecting portion 57 on the lower surface is positioned at a position facing the detecting unit 70 interposing the medium M in the up and down direction Z, and covers a wide area above the opening 33. Therefore, even if, for example, the medium M has transmittance, the light that passes through the medium M from the outside and faces the detecting unit 70 on the lower side of the opening 33 is blocked by the carriage 53. Concerning this point, the carriage 53 functions as a light-shielding portion that blocks light from passing through the medium M from the outside and facing the detecting unit 70 during transport of the medium M.

In addition, in a case where the pattern Pt on the rear surface of the medium M is detected by the detecting unit 70, preferably the medium M is transported with a stable posture without deflection or the like occurring on the support portion 30. Concerning this point, in the embodiment, the transport unit 40 that transports the medium M by rotating the medium M that is interposed from both the front and rear sides is positioned further on the upstream side of the transport direction than the support portion 30. Therefore, the medium M is transported to the downstream side in the transport direction with a stable posture in which the rear surface of the medium M is in non-contact with the upper surface of the support portion 30, and in that state, the pattern Pt on the rear surface is detected by the detecting unit 70 via the opening 33.

Note that, also during double-side printing, in the same manner as during single-side printing, before starting printing on the medium M, the position of the end portion of the medium M is detected by the detection unit 56 that is attached to the lower surface of the carriage 53. However, during double-side printing, the alignment pattern Pt and the image Img (Img 1) is printed on the rear surface of the medium M. Therefore, in a case where the medium M has transmittance such as a thin paper, the pattern Pt and the image Img (Img 1) that are printed on the rear surface may be seen through the front surface. As a result, there is a concern that in practice, a position at which the end portion of the medium M is not present is erroneously detected as the end portion of the medium M by changing the received light intensity at a boundary of a part in which the pattern Pt and the image Img (Img 1) are not transparent and the part in which the pattern Pt and the image Img (Img 1) are transparent.

However, as shown in FIG. 6, in the case of the embodiment, when the pattern Pt that is printed on the rear surface of the transported medium M is positioned at the detection position P, the detection unit 56 that is provided on the lower surface of the carriage 53 has a position deviated from the pattern Pt in the transport direction. That is, the detection unit 56 in this case faces a certain region further on the upstream side in the transport direction than the pattern Pt and further on the downstream side in the transport direction than the image Img (Img 1), that is, a non-printing region in which a printing material such as the pattern Pt and the image Img (Img 1) is not printed in the up and down direction Z. Therefore, a concern that influence on the pattern Pt and the like on the rear surface is erroneously detected when the end portion of the medium M is detected based on the received light intensity of the reflected light which is irradiated from the detection unit 56 on the lower surface of the carriage 53 toward the support portion 30.

According to the embodiment described above, it is possible to obtain the effects indicated below.

(1) The detecting unit 70 tends not to receive influence of the ambient light since there is a high possibility that light from a side that faces the detecting unit 70 interposing the medium M toward the detecting unit 70 is blocked by the carriage 53 that functions as a light-shielding portion. Therefore, the alignment pattern Pt that is printed on a rear surface of the medium M is detected at a position that faces the rear surface of the medium M, and it is possible to suppress erroneous detection of the pattern Pt according to influence of ambient light in a case where an image Img (Img 2) is printed on the front surface of the medium M based on the detection result.

(2) In a case where the medium M is transparent or semi-transparent, it is possible to reflect light, that is irradiated from the detecting unit 70, to a side at which the carriage 53, which is an example of the light-shielding portion, is positioned and passes through the medium M using the reflecting portion 57 that the carriage (light-shielding portion) 53 has, and receive the reflected light on the detecting unit 70 by passing through the medium M from the side at which the carriage (light-shielding portion) 53 is positioned to the side at which the detecting unit 70 is positioned.

(3) In double-side printing, it is possible to detect an alignment pattern Pt of a subsequent image from the rear surface of the medium M during printing of the previous image when a plurality of images Img (Img 2) are printed in a gap in the transport direction of the medium M with respect to the front surface of the transported medium M. Therefore, it is possible to seamlessly connect printing of a previous image and printing of a later image, and it is possible to improve throughput.

(4) It is possible to support the medium M in a stable posture state using the support portion 30 and it is possible to secure detection precision of the pattern Pt when the alignment pattern Pt that is printed on the rear surface of the medium M is detected by the detecting unit 70 at a position facing the rear surface of the medium M.

(5) It is possible to improve detection precision of the detecting unit 70 that receives reflected light which is emitted on the rear surface of the transported medium M in a so-called serial-type printing apparatus 10 that prints the image Img on the front surface of the medium M while the printing apparatus 10 moves the printing unit 50 in the width direction X of the medium M.

Note that, the embodiment may be modified as shown below.

Figure 7:
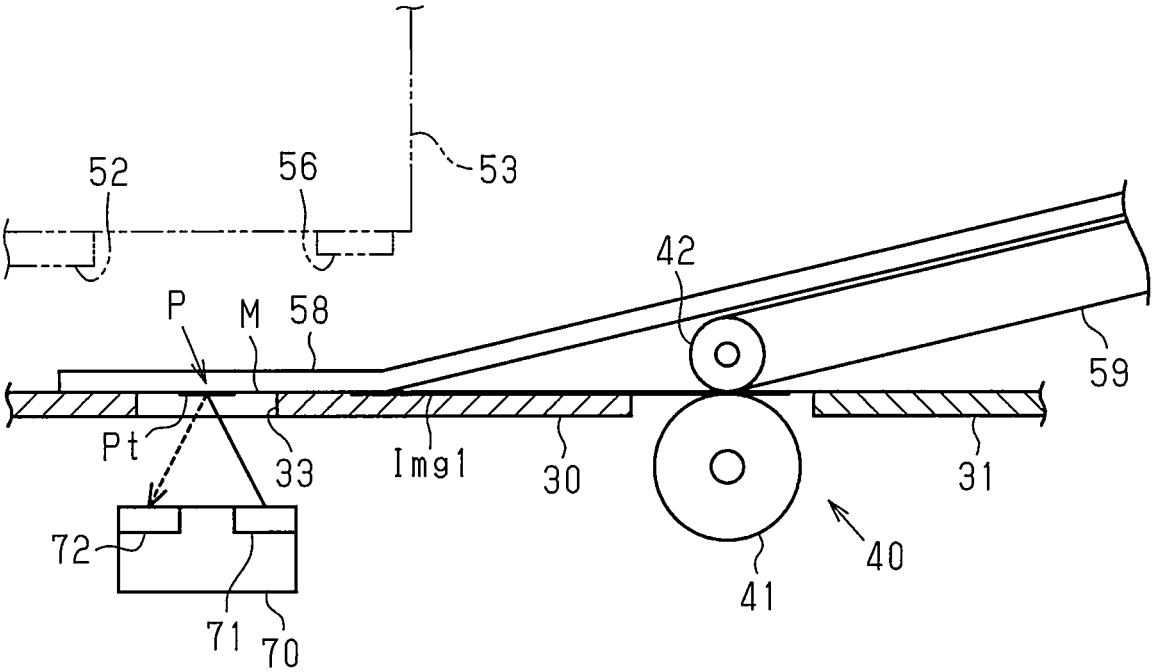
FIG. 7 is a side view illustrating an outline configuration of the main portion of a printing apparatus of a modification example.

As shown in FIG. 7, a light-shielding plate 58 with a plate metal form that is in surface contact with the region in which the opening 33 is formed on the support portion 30 in a support arm 59 that rotatably supports the driven roller 42 in the transport unit 40 may be provided as the light-shielding portion. In addition, in this case, preferably the surface on the side facing the support portion 30 of the light-shielding plate 58 has a white or mirror finish with high reflectance, the reflecting portion 57 may not be provided on the lower surface of the carriage 53, and the light-shielding plate 58 functions as the reflecting portion.

Figure 8:
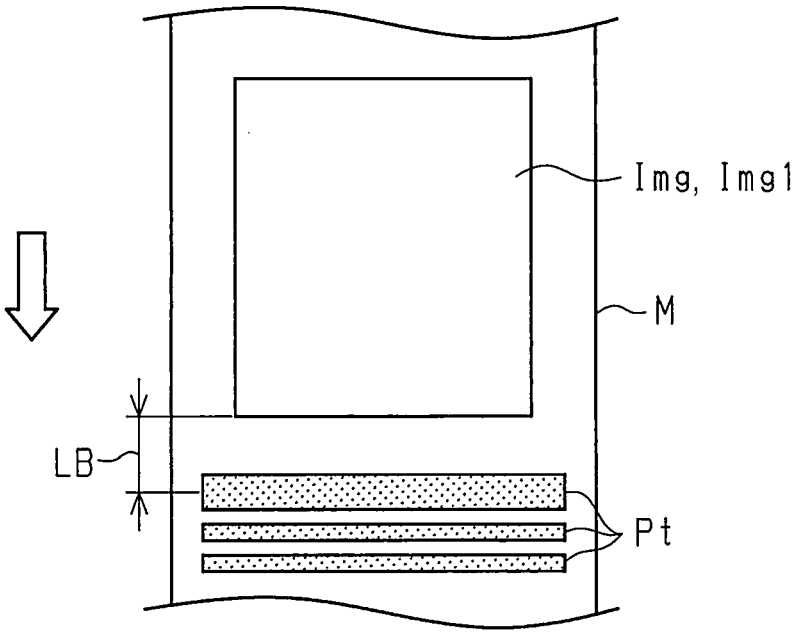
FIG. 8 is a planar view illustrating a medium that is printed on a single side in another modification example.

As shown in FIG. 8, the pattern Pt that is printed on the rear surface of the medium M during single-side printing before double-side printing may be a one-dimensional bar code that is constituted by a plurality of bars lined up in the transport direction in which the width direction X is the longitudinal direction and the transport direction is the transverse direction. In this case, it is possible to anticipate improvement of printing precision of double-side printing by embedding various printing information such as the length of the printed image Img, a managed number, and a residual amount of the medium M in a barcode that is constitutes the pattern Pt.

The light-shielding portion in the printing unit 50 may be constituted by attaching to the carriage 53 a light-shielding member that is separate from the carriage 53.

The detecting unit 70 may be disposed at a position further on the upstream side in the transport direction of the medium M than the support portion 30, for example, on the lower side of the upstream side guiding portion 31 not on the lower side of the support portion 30. In this case, preferably the opening 33 is formed on the upstream side guiding portion 31 and the detection position P is provided above the opening 33.

The detecting unit 70 may be disposed at a position further on the downstream side in the transport direction of the medium M than the support portion 30 and the printing unit 50, for example, on the lower side of the downstream side guiding portion 32 not on the lower side of the support portion 30. In this case, the opening 33 is formed on the downstream side guiding portion 32 and the detection position P is provided above the opening 33. For example, in a case where a gap of the printing position of the pattern Pt and the image Img (Img 2) in the transport direction is extremely long, even in such a configuration, it is possible to execute double-side printing without return transport of the medium M after detection of the pattern Pt. However, in a case where the printing gap LB is at the same extent as in the embodiment, the pattern Pt on the rear surface of the medium M is detected at the detection position P further on the downstream side in the transport direction than the printing unit 50, then it is necessary to return transport the medium M to the upstream side in the transport direction.

In a case where the medium M is white plain paper or the like that does not have transmittance, exceptionally, the reflecting portion may not be provided.

The printing apparatus 10 may be a printer that performs printing on a single slip of paper.

The printing apparatus 10 may not be a serial-type printing apparatus such as in the embodiment, and may be a so-called line head-type printing apparatus that is provided such that the discharge portion 52 faces the support portion 30 across the entirety of the width direction X of the medium M. In this case, preferably the light-shielding plate 58 as indicated in FIG. 7 is provided as the light-shielding portion.

The printing apparatus 10 is not limited to a printer that prints by discharging ink. The printing apparatus 10 may be a non-impact printer such as a laser printer, an LED printer, and a thermal transfer printer (a sublimation printer), and may be an impact printer such as a dot impact printer.

This application claims priority under 35 U.S.C. § 119 to Japanese Patent Application No. 2017-052596, filed Mar. 17, 2017. The entire disclosure of Japanese Patent Application No. 2017-052596 is hereby incorporated herein by reference.

What is claimed is:

1. A printing apparatus comprising:

a transport unit configured to transport a medium in a transport direction, the medium including a front surface that is currently being printed on and a rear surface being at an opposite side of the front surface;

a support portion configured to support the medium, which is transported by the transport unit, in a width direction that intersects with the transport direction;

a discharge portion configured to discharge ink on the front surface of the medium which is supported by the support portion;

a detecting unit comprising a light projection portion and a light receiving portion, the light receiving portion configured to receive reflected light which is emitted from the light projecting portion, and reflected by the rear surface of the medium that is transported on a detection position that is provided in a transport path of the medium, the detecting unit configured to detect an alignment pattern on the rear surface of the medium, the alignment pattern being previously printed by the discharge portion; and a carriage configured to, when in a particular position along the width direction, face the detecting unit with the medium interposed therebetween during at least transport of the medium by the transport unit.

2. The printing apparatus according to claim 1, wherein the carriage has a reflecting portion that is able to reflect light, that is irradiated from the light projection portion of the detecting unit, toward the light receiving portion of the detecting unit when an end portion of the medium is transported away from the detecting unit, and based on a change of the reflection light from the reflection light being reflected by the medium to the reflection light being reflected by the reflection portion, the detecting unit detects the alignment pattern.

3. The printing apparatus according to claim 1, wherein the detecting unit is positioned further on an upstream side of the discharge portion in the transport direction.

4. The printing apparatus according to claim 3, wherein the transport unit is positioned further on an upstream side of the support portion in the transport direction, and the detecting unit detects the alignment pattern from the rear surface of the medium when the rear surface of the medium is in a state of being supported by the support portion.

5. The printing apparatus according to claim 1, further comprising:

an optical detection unit configured to detect an end portion of the medium in the width direction, and provided on a lower surface of the carriage, the optical detection unit comprising:

a light projecting portion configured to irradiate light toward the medium or the support portion;

a light receiving portion configured to receive reflected light from the medium or the support portion, and based on a change of the reflection light from the reflection light being reflected by the medium to the reflection light being reflected by the support portion, the optical detection unit detects the end portion of the medium in the width direction.

6. The printing apparatus according to claim 5, wherein the light projecting portion of the optical detection unit is configured to irradiate the light in a position upstream than the detecting unit in the transport direction.

7. The printing apparatus according to claim 6, wherein the optical detection unit is provided upstream than the discharge portion in the transport direction.

8. The printing apparatus according to claim 5, wherein the optical detection unit is provided upstream than the discharge portion in the transport direction.

* * * * *